US005351579A

United States Patent [19]

Metz et al.

[11] Patent Number: 5,351,579

[45] Date of Patent: Oct. 4, 1994

[54] RECHARGEABLE ELECTRIC CORKSCREW

[76] Inventors: Robert Metz, 12 Nantucket Boulevard, Scarborough, Ontario, Canada, M1P 4W7; Dusan Nikolic, 225 Erskine Avenue, Toronto, Ontario, Canada, M4P 1Z5

[21] Appl. No.: 64,305

[22] Filed: May 20, 1993

[51] Int. Cl.[5] ..... B67B 7/04

[52] U.S. Cl. ..... 81/3.2; 81/3.29; 81/3.45; 30/1.5

[58] Field of Search ..... 81/3.33, 3.45, 3.29, 81/3.36, 3.37, 3.2, 3.07; 30/1.5; 7/151, 155, 156

[56] References Cited

U.S. PATENT DOCUMENTS

| | | | |
|---|---|---|---|
| 519,021 | 5/1894 | Kraft . | |
| 844,396 | 2/1907 | Pfab . | |
| 1,057,492 | 4/1913 | Munzinger . | |
| 1,938,484 | 12/1933 | Clarin . | |
| 4,845,844 | 7/1989 | Allen | 30/1.5 |
| 5,079,975 | 1/1992 | Spencer, Jr. . | |
| 5,095,778 | 3/1992 | Basci et al. . | |

FOREIGN PATENT DOCUMENTS

| | | |
|---|---|---|
| 0129301 | 12/1984 | European Pat. Off. . |
| 2608143 | 6/1988 | France . |
| 2199813 | 7/1988 | United Kingdom . |

*Primary Examiner*—Roscoe V. Parker

*Attorney, Agent, or Firm*—Jeffrey T. Imai; Arne I. Fors; D. Doak Horne

[57] ABSTRACT

A rechargeable electric corkscrew for removing a cork from a bottle comprises a reversible drive having a switch for switching the drive between rotation in a first sense and an opposite sense. A body houses the drive and a rechargeable power source and has a rotatably mounted auger extending in a longitudinal direction. A sleeve has a first end adapted for slidably mounting onto the body. The sleeve has a second end surrounding the auger comprising cantilevered members each having an abutment surface adapted to abut a mouth of the bottle. The cantilevered members are adapted to flex for positioning the abutment surfaces relative to each other about the mouth. The cantilevered members has a base end having a radial extent for stably supporting the corkscrew in an upright condition. The corkscrew is also provided with a cutter for cutting a foil wrapper which covers the mouth of the bottle.

12 Claims, 4 Drawing Sheets

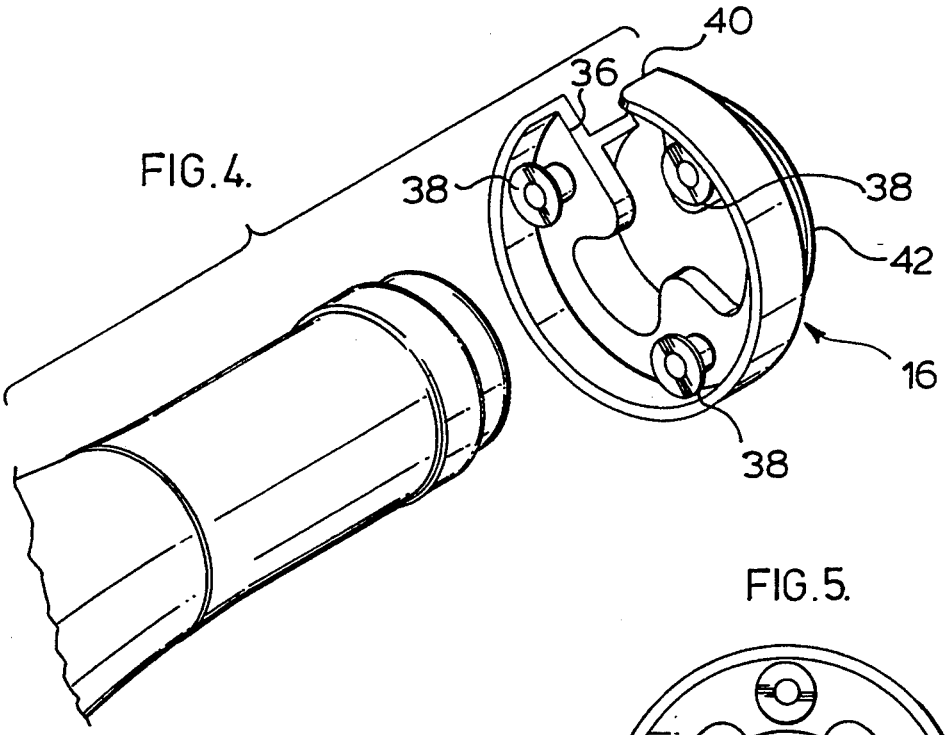
FIG. 4.
FIG. 5.
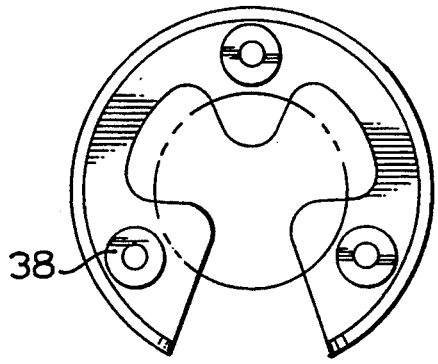
FIG. 6.
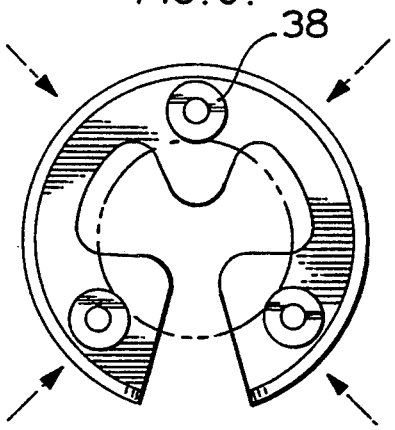
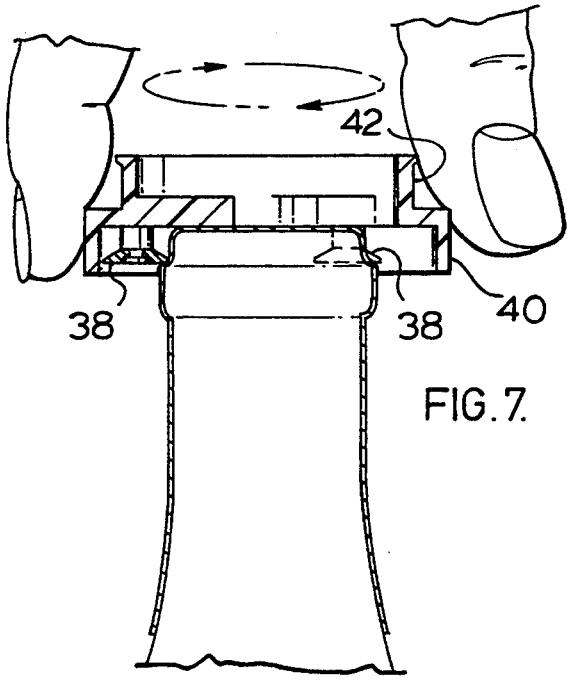
FIG. 7.

RECHARGEABLE ELECTRIC CORKSCREW

FIELD OF INVENTION

This invention relates to an automatic corkscrew which is powered by a chargeable battery.

BACKGROUND OF THE INVENTION

Corkscrews are available in many different varieties, both manual and electric. Conventional manual corkscrews, while inexpensive to manufacture, are often difficult to insert into the cork, difficult to manipulate and often damage the cork as it is extracted from the bottle.

Automatic corkscrews generally are easier to operate. Such corkscrews generally comprise a motor driven auger. The auger is rotated into the cork and as the auger continues to rotate, the cork is pulled upwardly for extraction. Examples of such devices are described U.S. Pat. Nos. 5,079,975 and 5,095,778. Although such devices can extract a cork from a bottle, the devices do not stand in an upright position very well. To prevent such devices from rolling off the edge of a bar or counter surface, these devices are likely to be placed in a drawer out of sight. This feature detracts from the corkscrew's attractiveness as a gift item and ultimately it's marketability.

In order to remove a cork from a bottle, the sealing label which cover the cork and bottleneck of unopened bottles must be removed. Some corkscrews provide a small knife to cut the sealing label. The knife is used to cut the sealing label off the bottle, allowing access to the cork for extracting the cork from the bottle. Otherwise, the tip of the corkscrew must be used to cut the label, which is sometimes difficult to accomplish.

Automatic corkscrews, such as those described in the above-mentioned U.S. patents, do not include a mechanism for cutting the sealing label from the bottle prior to extracting the cork. Such devices require a separate cutting device. The user must therefore have a knife handy to remove the sealing label.

SUMMARY OF THE INVENTION

The disadvantages of the prior art may be overcome by providing an automatic corkscrew which can stably stand in an upright condition and which is powered by a rechargeable battery and has a detachable cutting device for cutting the sealing label from the bottle.

It is further desirable to provide a detachable cutting device which releasably mounts onto the base of the housing of the automatic corkscrew to enhance the upright stability of the corkscrew.

According to one aspect of the invention, there is provided a rechargeable electric corkscrew for removing a cork from a bottle. The corkscrew comprises a reversible drive having a switch for switching the drive between rotation in a first sense and an opposite sense. A rechargeable power source powers the drive. The housing comprises a body for housing the drive and the power source and for rotatably mounting an auger to extend in a longitudinal direction. A sleeve has a first end adapted for slidably mounting onto the body. The sleeve is slidable in the longitudinal direction between a rest position wherein the sleeve and body are in an abutting relation to a cork removal position wherein the sleeve and body are in an extended condition. The sleeve has a second end surrounding the auger comprising cantilevered members each having an abutment surface adapted to abut a mouth of the bottle. The cantilevered members are adapted to flex for positioning the abutment surfaces relative to each other about the mouth. The sleeve has a longitudinal extent for extending beyond the auger when the body and sleeve are in the rest condition. The cantilevered members has a base end having a radial extent for stably supporting the corkscrew in an upright condition. A contact is adapted to electrically connect the rechargeable power source to a recharger.

In another aspect of the invention, there is provided a cork removal mechanism for retaining the cork as said auger is extracted therefrom. The cork removal mechanism comprises a cork holder slidably engaging the cantilevered members for longitudinal travel. The cork holder has a button slidably mounted therein to extend inwardly of the sleeve and biased in an unextended condition. Pressing the buttons urges the base of the buttons inwardly to hold the cork stationary allowing the auger to rotate relative to the cork for extraction.

In another aspect of the invention, the corkscrew is provided with a cutter for cutting a foil wrapper which covers the mouth of the bottle. The cutter comprises a ring member having a circumferentially extending planar surface and has a plurality of rotatable cutters circumferentially spaced thereabout. The rotatable cutters are spaced from the planar surface. The ring is adapted to flex for urging the opposite ends together to closing the cutters onto the mouth. The base end of the cantilevered members is adapted to snappingly receive the cutters and the cutter member is releasably connected thereto.

DESCRIPTION OF THE DRAWINGS

In drawings which illustrate embodiments of the invention,

FIG. 4 is a perspective view of the cutter mechanism of the invention of FIG. 1 aligned with a bottle;

FIG. 5 is a bottom plan view of the cutter mechanism of FIG. 4 positioned over a bottle mouth;

FIG. 6 is a bottom plan view of the cutter of FIG. 4 with the ring member in a compressed condition;

FIG. 7 is a side sectional elevational view of the cutter mechanism of FIG. 4 cutting the sealing label off a bottle;

DETAILED DESCRIPTION OF THE INVENTION

Figure 1:
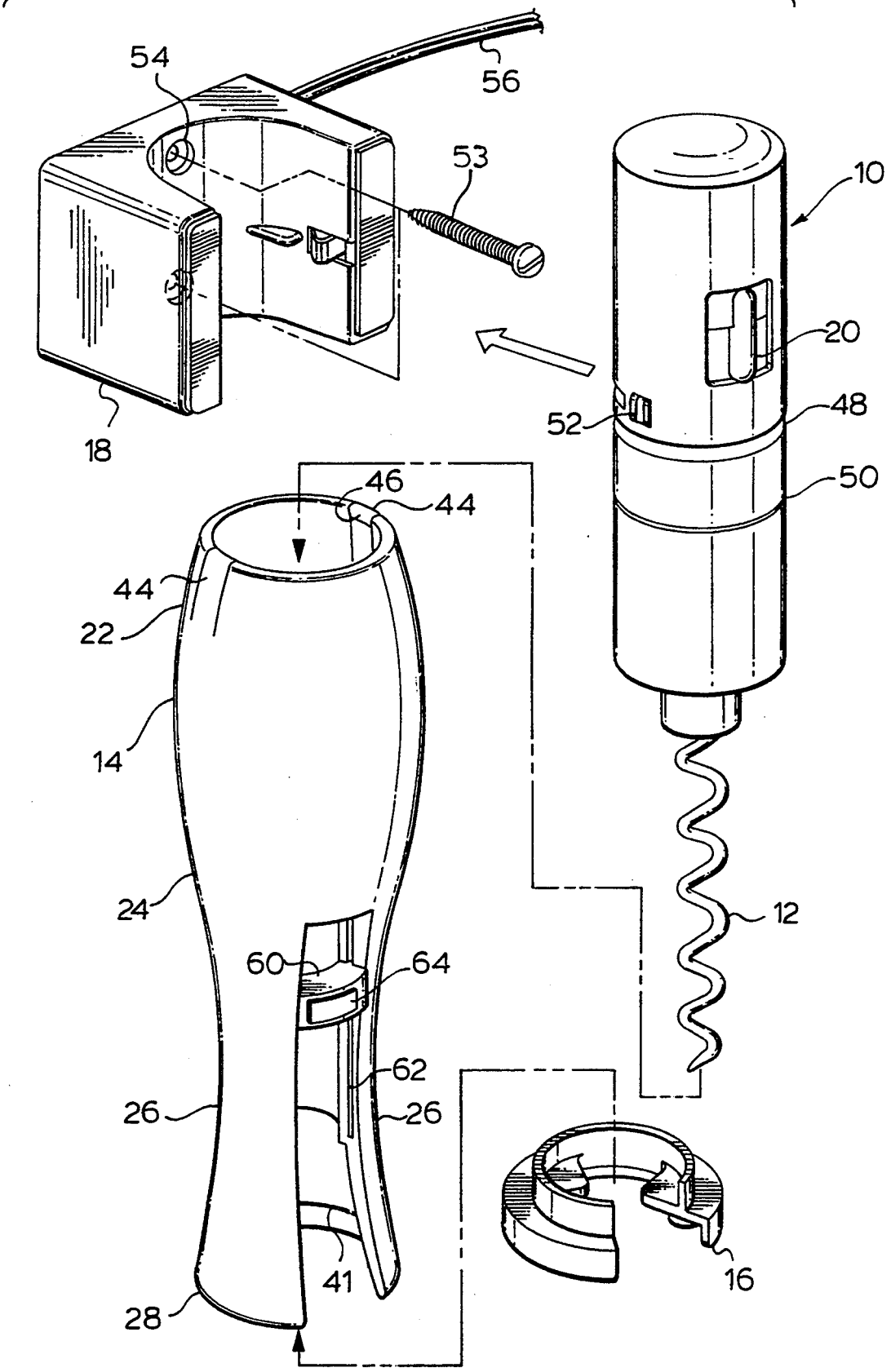
FIG. 1 is an exploded perspective view of the corkscrew of the present invention.
Figure 2:
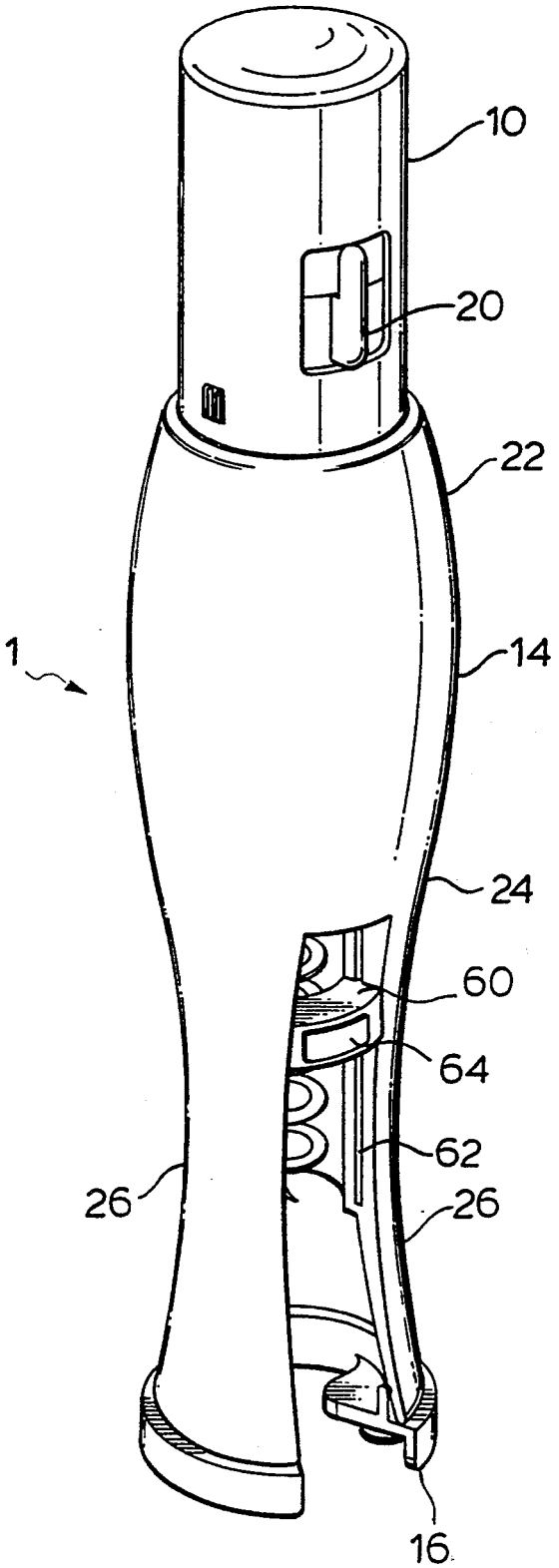
FIG. 2 is a perspective view of the invention of FIG. 1 in an assembled condition.

Referring FIGS. 1 and 2, the rechargeable automatic corkscrew 1 in the present invention is shown. The rechargeable automatic corkscrew 1 has a drive body 10, an auger or corkscrew 12, a sleeve 14, a cutter 16 and a recharger 18.

The exterior of drive body 10 has a reversible switch 20 for rotating the auger in a first sense and an opposite sense. Drive body 10 generally has acylindrical shape having a longitudinal axis. Auger 12 is rotatably mounted to extend from one end of drive body 10 in the longitudinal direction. The drive body 10 incorporates a construction used in conventional cordless screwdrivers. Such construction and operation are well known to those skilled in the art.

Sleeve 14 has a first end 22 having an inside diameter adapted to slidingly receive drive body 10. The opposite end 24 of sleeve 14 has a plurality of cantilevered members 26. Cantilevered members 26 are integral with sleeve 14 and made of a material which allows the base end 28 to flex relative to each other. The internal surface of cantilevered members 26 extends circumferentially to allow passage of a cork in a longitudinal direction. The cantilevered members 26 have a bottle abutment surface 34 on the inner surface thereof. Surface 34 extends circumferentially and is intermediate the length of cantilevers 26.

Optionally, sleeve 14 is provided with snap members 44. Snap members 44 have a lip formation 46 and biased to extend inwardly. Drive body 10 has circumferentially extending grooves 48 and 50. As drive body 10 is slid relative to sleeve 14, lip formation 46 will snap into grooves 48 and 50. Groove48 corresponds to the rest condition when drive body 10 abuts against abutment surface 32. Circumferential groove 50 corresponds to a cork removal condition when the drive body 10 is extended from sleeve 14.

Figure 3:
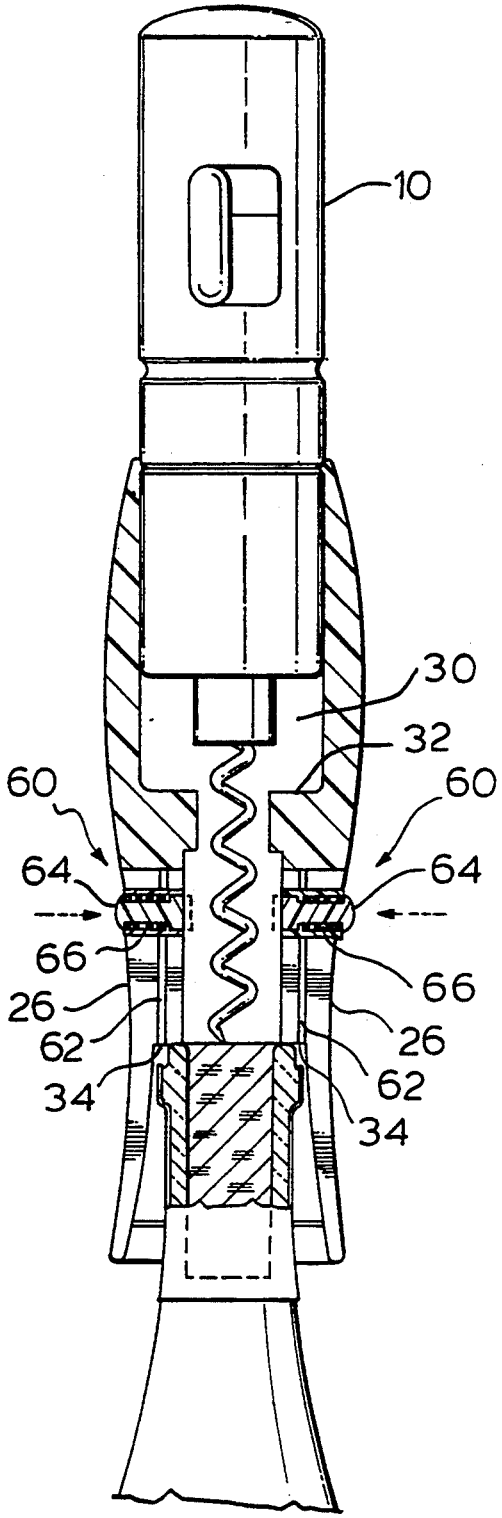
FIG. 3 is a side elevational view, partially in section, of the invention of FIG. 1, with the corkscrew in a cork removal condition.

Referring to FIG. 3, the cross section of sleeve 14 is more specifically illustrated. End 22 has an internal channel 30 for receiving drive body 10 which terminates in an abutment shoulder 32. As is apparent, drive body 10 can slide relative to the sleeve 14 from an extended position as illustrated to a rest position wherein the drive body 10 abuts with abutment shoulder 32.

Referring to FIG. 4, cutter 16 comprises a ring member 36 defining a circumferentially extending planar surface. Circumferentially spaced about ring member 36 are a plurality of rotatable cutters 38. The cutters 38 are spaced a relatively short distance from the planar surface of ring 36. Extending downwardly from ring member 36 is circumferential wall 40. Extending upwardly from ring member 36 is sleeve 42. Sleeve 42 is sized to frictionally or snappingly fit within base end 38 of the cantilever members for releasably connecting the cutter 16 to sleeve 14. For a snapping fit, the inner surface of base end 28 is provided with a lip 41 which extends circumferentially thereabout.

As is illustrated in FIG. 4, cutter 16 has a split construction and manufactured from a material allowing the cutter to flex and contract as illustrated in FIG. 6 to accommodate different sizes of bottles.

In use, the corkscrew of the present invention will be standing in an upright condition as illustrated in FIG. 2. When the user desires to uncork a bottle, the user removes the cutter 16 from the base end 28 of the sleeve. The corkscrew is left standing in an upright condition. The bottom surface of ring member 36 is presented to the top of the bottle as illustrated in FIG. 7.

As illustrated in FIG. 6, the user squeezes the ring member 36 causing it to flex urging the cutters 38 to fully contact the outside diameter of the bottle for cutting the foil cover member. Once cut, the user removes the top of the foil which was cut away. The cutter is then placed to the side.

The user then extends the automatic corkscrew of the present invention from the rest position to the extended cork removal position by pulling the drive body 10 relative to the sleeve 14 from groove 48 to groove 50. The sleeve member is then presented coaxially with the bottle until the mouth of the bottle abuts surface 34. The base end 28 can flex inwardly or outwardly to accommodate the various sizes of mouths of the bottle. The user can grip the cantilevered members against the bottle mouth.

Figure 8:
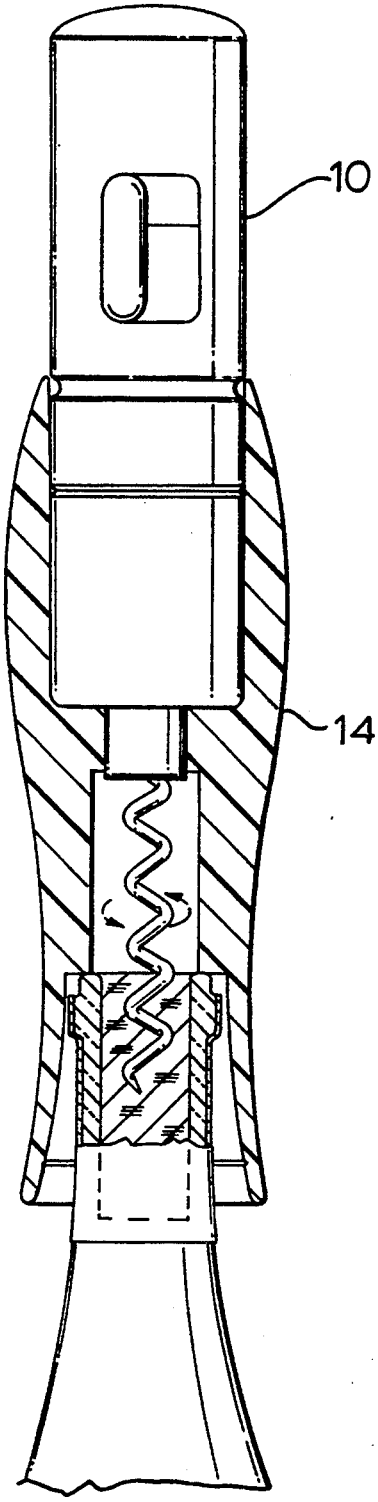
FIG. 8 is a side elevational view, partially in section, of the invention of FIG. 1, with the corkscrew in a rest condition and the auger penetrating the cork.
Figure 9:
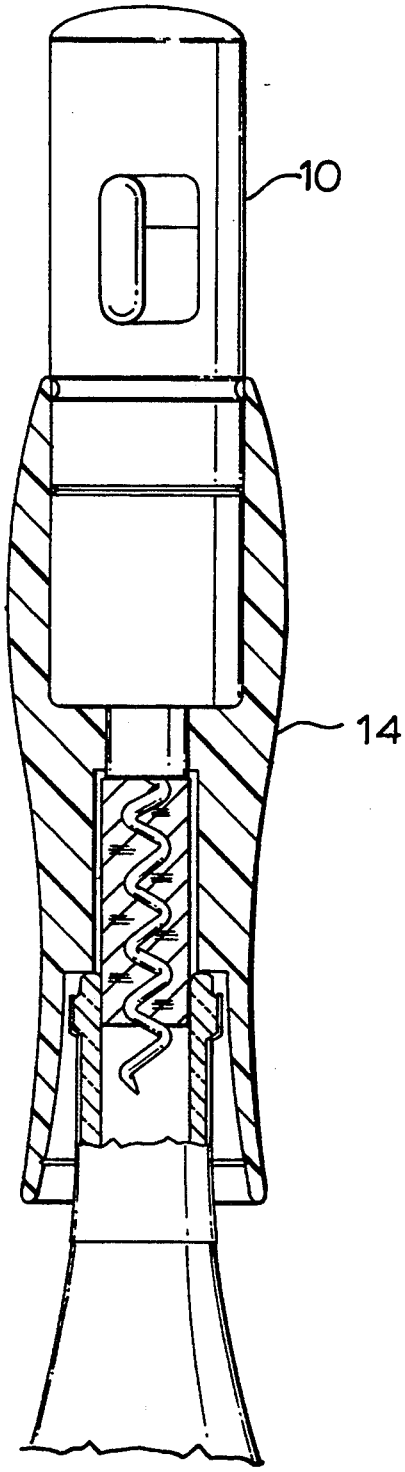
FIG. 9 is a side elevational view, partially in section, of the invention of FIG. 1, with the corkscrew in a rest condition and the auger extracting the cork.

Referring to FIG. 8 and 9, the user urges the drive body 10 downwardly until the tip of the corkscrew contacts the cork. The user then switches switch 20 causing the auger 12 to rotate in a first sense advancing the auger 12 into the cork. As the auger 12 advances, the drive body 10 will move downwardly relative to the sleeve 14 until the drive unit 10 abuts surface 32. At this point, the bottle, sleeve and drive unit abut one another. Further rotation of the auger 12 advances the cork along the auger 12 extracting the cork from the bottle. The auger 12 continues to rotate until the cork is substantially removed from the bottle. At this point, the switch 20 is switched off whereupon the user grabs the sleeve 14, gently urging the sleeve upwardly fully extracting the cork from the bottle.

To remove the cork from the auger 12, the user places some pressure on the cork between the cantilevered members 26 and switches the switch 20 to a reverse position causing the auger to rotate in the opposite sense. The cork will travel relative to the auger 12 until fully removed.

Optionally, sleeve 14 can be provided with a cork removal mechanism as illustrated in FIG. 2 and 3. Two cork holders 60 are slidingly mounted within longitudinally extending grooves 62 on the inside surface of each cantilevered member 26. Cork holder 60 comprises a button 64 which is spring loaded by spring 66 urging the button outwardly. When depressed, the base of button 64 extends inwardly into the path of the cork. Preferably when in a rest position, the head of the button lies flush with the circumferential extend of the outer surface of the cantilevered members 26.

To remove the cork from the auger 12 using the cork removal mechanism, the user places some pressure on each button 64 placing pressure on the cork and switches the switch 20 to a reverse position causing the auger to rotate in the opposite sense. The cork will travel relative to the auger 12 until fully removed as the cork holder 60 slides along the grooves 62.

The cutter member 16 is then reattached to the base end 28 of sleeve 24, the drive body 10 is urged back into the rest position into groove 48 and then returned to the place of storage in an upright condition.

When not in use, the drive unit 10 is placed in the recharger unit 18 for recharging of the rechargeable power source or battery. The exterior of drive body 10 is provided with contacts 52 which provide an electrical connection when drive body 10 is nested within recharger unit 18.

For ease of storage and recharging, the recharging unit 18 can be mounted on a wall or other surface by a screw 52 which passes through a hole 54 in the recharging unit 18. The recharging unit should be mounted near to an electrical outlet to allow the electrical cord 56 to be plugged into an electrical outlet (not illustrated).

Although the disclosure describes and illustrates preferred embodiment of the invention, it is to be understood that the invention is not limited to this particular embodiment. Many variations and modifications will now occur to those skilled in the art. For a definition of the invention, reference is to be made to the appended claims.

We claim:

1. A rechargeable electric corkscrew for removing a cork from a bottle comprising:

a reversible drive means, an auger driven by said drive means, a housing having a longitudinal axis, comprising a body for housing said drive means and a power source and for rotatably mounting said auger to extend in a longitudinal direction, and a sleeve having a first end adapted for slidably mounting onto said body, said sleeve being slidable in said longitudinal direction between a rest position wherein said sleeve and body are in an abutting relation to a cork removal position wherein said sleeve and body are in an extended condition, said sleeve having a second end surrounding said auger comprising cantilevered members each having an abutment surface adapted to abut a mouth of said bottle, said cantilevered members adapted to flex for positioning said abutment surfaces relative to each other about said mouth, said sleeve having a longitudinal extent for extending beyond said auger when said body and sleeve are in the rest condition, said cantilevered members having a terminal end having a radial extent for stably supporting said corkscrew in an upright condition, wherein said auger is rotated in a first sense advancing the auger into the cork and advancing said body from the cork removal position towards the rest position, whereafter the auger extracts the cork between the cantilevered members and wherein said auger is rotated in a sense opposite said first sense and relative to said cork, extracting said auger from said cork.

2. A corkscrew as claimed in claim 1 wherein said corkscrew further comprises a cutter means for cutting a foil wrapper which covers the mouth of said bottle.

3. A corkscrew as claimed in claim 2 wherein said cutter means comprises a ring member having a circumferentially extending planar surface and having a plurality of rotatable cutters circumferentially spaced thereabout, said rotatable cutters spaced from said planar surface, whereby when said planar surface abuts said mouth and said ring is rotated thereabout, said wrapper is cut below said mouth.

4. A corkscrew as claimed in claim 3 wherein said ring is split having opposite ends and said ring adapted to flex for urging said opposite ends together to closing said cutters onto said mouth.

5. A corkscrew as claimed in claim 4 wherein said terminal end of said cantilevered members is adapted to receive said cutters means and said cutter member is releasably connected thereto.

6. A corkscrew as claimed in claim 5 wherein said cutters means is received by said cantilevered members in a snapping fit.

7. A corkscrew as claimed in claim 6 wherein said corkscrew further comprises a switch means for switching said drive means between said rotation in said first sense and said opposite sense.

8. A corkscrew as claimed in claim 7 wherein said corkscrew further comprises a recharger means for recharging said power source.

9. A corkscrew as claimed in claim 8 wherein said housing means has a contact, said contact adapted to electrically connect said power source to said recharger means.

10. A corkscrew as claimed in claimed in claim 1 wherein said corkscrew further comprises a cork removal means for retaining said cork as said auger is extracted therefrom.

11. A corkscrew as claimed in claim 10 wherein said cork removal means comprises cork holder slidably engaging said cantilevered members for longitudinal travel, said cork holder having a button slidably mounted in said holder to extend inwardly of the sleeve and biased in an unextended condition.

12. A rechargeable electric corkscrew for removing a cork from a bottle comprising:

a reversible drive means having a switch means for switching said drive means between rotation in a first sense and an opposite sense, an auger driven by said drive means, a housing having a longitudinal axis, comprising a body for housing said drive means and a power source and for rotatably mounting said auger to extend in a longitudinal direction, a sleeve having a first end adapted for slidably mounting onto said body, said sleeve being slidable in said longitudinal direction between a rest position wherein said sleeve and body are in an abutting relation to a cork removal position wherein said sleeve and body are in an extended condition, said sleeve having a second end surrounding said auger comprising cantilevered members each having an abutment surface adapted to abut a mouth of said bottle, said cantilevered members adapted to flex for positioning said abutment surfaces relative to each other about said mouth, said sleeve having a longitudinal extent for extending beyond said auger when said body and sleeve are in the rest condition, said cantilevered members having a terminal end having a radial extent for stably supporting said corkscrew in an upright condition, and a contact adapted to electrically connect said power source to a recharger means for recharging a rechargeable battery for powering said drive means, a cork removal means for retaining said cork as said auger is extracted therefrom comprising cork holder slidably engaging said cantilevered members for longitudinal travel, said cork holder having a button slidably mounted in said holder to extend inwardly of the sleeve and biased in an unextended condition, and a cutter means for cutting a foil wrapper which covers the mouth of said bottle, said cutter means comprising a ring member having a circumferentially extending planar surface and having a plurality of rotatable cutters circumferentially spaced thereabout, said rotatable cutters spaced from said planar surface, said ring adapted to flex for urging said opposite ends together to closing said cutters onto said mouth, said terminal end of said cantilevered members is adapted to snappingly receive said cutters means and said cutter member is releasably connected thereto, wherein said auger is rotated in said first sense advancing the auger into the cork and advancing said body from the cork removal position towards the rest position, whereafter the auger extracts the cork between the cantilevered members and wherein said auger is rotated in said sense opposite and relative to said cork, extracting said auger from said cork.

* * * * *